US007686647B1

(12) United States Patent
Hong

(10) Patent No.: US 7,686,647 B1
(45) Date of Patent: Mar. 30, 2010

(54) TERMINAL ASSEMBLY AND SEALED ELECTRICAL CONNECTOR

(75) Inventor: Kin Boon Hong, Singapore (SG)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 12/255,288

(22) Filed: Oct. 21, 2008

(51) Int. Cl.
*H01R 13/40* (2006.01)

(52) U.S. Cl. ..... 439/595

(58) Field of Classification Search ..... 439/595, 439/589, 587, 274, 255
See application file for complete search history.

(56) References Cited

U.S. PATENT DOCUMENTS 5,437,563 A 8/1995 Kihira et al.
5,975,950 A * 11/1999 Yamaguchi ..... 439/585
6,039,605 A * 3/2000 Tanaka ..... 439/607.44
6,210,223 B1 4/2001 Aoyama et al.
6,384,335 B1 5/2002 Saito et al.
6,554,644 B2 4/2003 Koide

* cited by examiner

*Primary Examiner*—Phuong K Dinh
(74) *Attorney, Agent, or Firm*—Rader, Fishman & Grauer, PLLC

(57) ABSTRACT

A terminal assembly includes a cable, an electrically-conductive terminal piece, a cavity block member and an electrically-conductive shielding member. The cable has an electrically-conductive core strand, an electrically non-conductive wire insulation surrounding the core strand, an electrically-conductive shield layer surrounding the wire insulation and an electrically non-conductive sheath surrounding the shield layer. The terminal piece is electrically connected to the core strand. The cavity block member defines a cavity block member passageway extending through the cavity block member. The cavity block member passageway is sized to slidably receive and retain the terminal piece therein. The shielding member defines a shielding member passageway extending through the shielding member. The shielding member passageway is sized to slidably receive the cavity block member. The shielding member is connected to the shield layer. The terminal assembly is employed with a receiving connector assembly and an insertable connector assembly to form a sealed electrical connector.

22 Claims, 9 Drawing Sheets

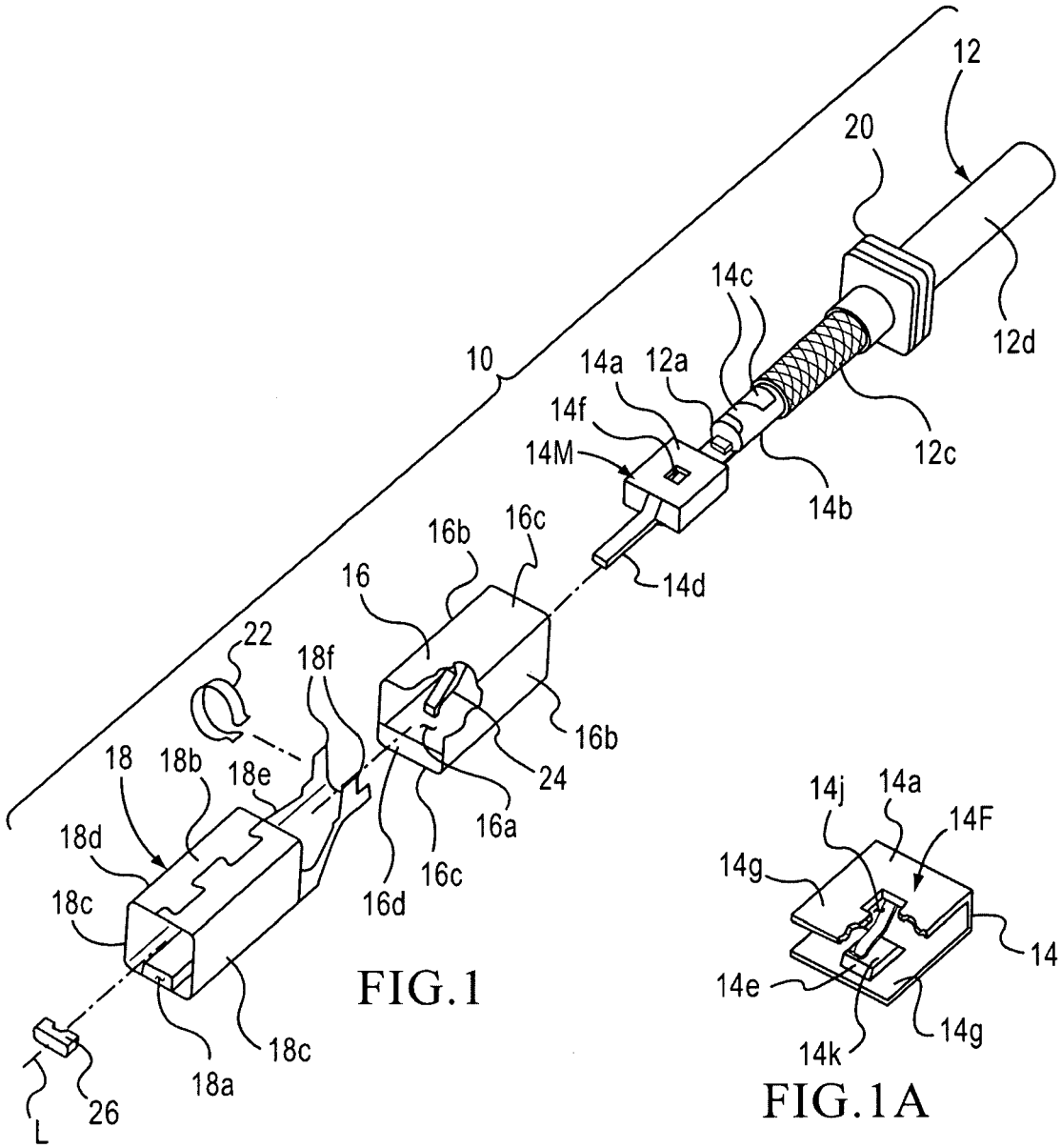
FIG.1
FIG.1A
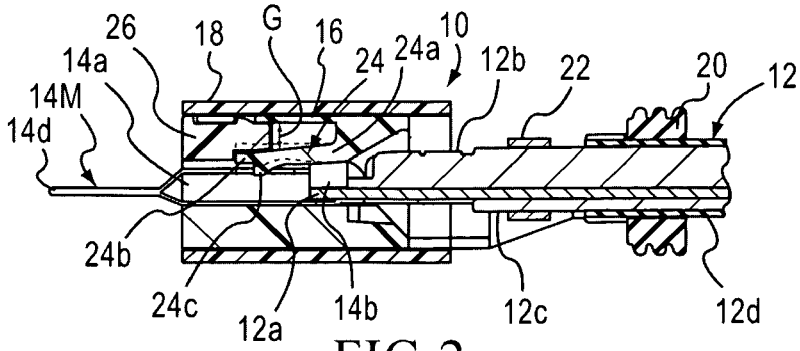
FIG.2

TERMINAL ASSEMBLY AND SEALED ELECTRICAL CONNECTOR

FIELD OF THE INVENTION

The present invention relates to an electrical connector. More particularly, the present invention is directed to a sealed electrical connector and terminal assemblies as components of the sealed electrical connector.

BACKGROUND OF THE INVENTION

Electrical connectors are well known in the art. For instance, U.S. Pat. No. 6,554,644 teaches a shielding terminal for connection to an end of a shielded cable. The shielded cable has a core and a shield layer surrounding and spaced from the core. The shielding terminal includes an outer terminal, a dielectric element, an inner terminal, at least one metal lock and at least one locking hole. The outer terminal is configured for connection with the shield layer of the shielded cable. The dielectric element is disposed at least partly in the outer terminal and the dielectric element has an inner surface and at least one projection projecting from the inner surface. The inner terminal is disposed at least partly in the dielectric element and is configured for connection with the core of the shielded cable. The inner terminal is formed with at least one resilient contact piece for contacting a mating terminal. The at least one metal lock is formed in an outer surface of the inner terminal. The at least one locking hole is formed in an inner surface of the dielectric element and is configured for engagement by the metal lock. The at least one projection projecting from the inner surface of the dielectric element at least partly fills a clearance between the inner surface of the dielectric element and the inner terminal in a direction substantially parallel to a resilient deforming direction of the resilient contact piece and for contacting the outer surface on the inner terminal.

Shielding terminals such as the one disclosed in U.S. Pat. No. 6,554,644 have drawbacks. For example, the braided wire on the connecting cable is sometimes large, thus, requiring a large crimp. Crimping on a large braided wire is sometimes difficult to control.

U.S. Pat. No. 5,437,563 discloses a water-proof shielded connector that has a first connector housing with accommodating chambers for accommodating a terminal provided at an end of at least one core disposed from an end of a shielded wire. The shielded wire is covered with a shield cover made of conductive materials. Both the connector housing and the shield cover are respectively engaged with a counterpart second connector housing and shield cover of a terminal connecting side. The first and second connector housings are a pair of male and female connectors having respective outer and inner periphery portions. The outer and inner periphery portions face each other. The water-proof shielded connector includes a first sealing member and a second sealing member. The first sealing member is provided in a water-proof sealing relationship between respective outer and inner periphery portions of the first and second connector housings. The first sealing member is compressed in a radial direction. The second sealing member is provided in a water-proof sealing relationship between the shielded wire and a wire inserting portion of the connector housing.

Water-proof shielded connectors such as the one disclosed in U.S. Pat. No. 5,437,563 also have drawbacks. Note that for the disclosed water-proof shielded connector a shielding enveloping all of the terminals is used. Such shielding is large and sometimes causes difficulty in achieving a reliable crimp.

Furthermore, a new shield size and a new crimp size are required to accommodate each different one of connector positions.

It would be beneficial to provide a sealed electrical connector that would be easier to control crimping of the terminal onto a large braided wire. It would also be beneficial to provide a sealed electrical connector that can accommodate different connector positions without having to change the size of the shield or the crimp. The present invention provides these benefits.

OBJECTS AND SUMMARY OF THE INVENTION

It is an object of the invention to provide a sealed electrical connector that would be easier to control crimping of the terminal onto a large braided wire.

It is another object of the invention to provide a sealed electrical connector that can accommodate different connector positions without having to change the size of the shield or the crimp.

Accordingly, exemplary embodiments of the present invention are hereinafter described.

One exemplary embodiment of a terminal assembly of the present invention includes a cable, an electrically-conductive terminal piece, a longitudinally-extending cavity block member and a longitudinally-extending, electrically-conductive shielding member. The cable has an electrically-conductive core strand, electrically non-conductive wire insulation surrounding the core strand, an electrically-conductive shield layer surrounding the wire insulation and an electrically non-conductive sheath surrounding the shield layer. The terminal piece is electrically connected to the core strand. The cavity block member defines a cavity block member passageway that extends longitudinally through the cavity block member. The cavity block member passageway is sized and adapted to slidably receive and retain the terminal piece therein. The shielding member defines a shielding member passageway that extends longitudinally through the shielding member. The shielding member passageway is sized to slidably receive the cavity block member. The shielding member is connected to the shield layer.

Another exemplary embodiment of the present invention is a sealed electrical connector. The sealed electrical connector includes a first terminal assembly, a receiving connector housing, a second terminal assembly, an insertable connector housing and a connector seal. The first terminal assembly is either a male terminal assembly or a female terminal assembly as described above. The second terminal assembly is a remaining one of the male terminal assembly and the female terminal assembly. The first terminal assembly includes a first cable that has an electrically-conductive first core strand, electrically non-conductive first wire insulation surrounding the first core strand, an electrically-conductive first shield layer surrounding the first wire insulation and an electrically non-conductive first sheath surrounding the first shield layer. An electrically-conductive first terminal piece is connected to the first core strand. A longitudinally-extending first cavity block member defines a first cavity block member passageway extending longitudinally through the first cavity block member. The first terminal piece is slidably received and is fixed in the first cavity block member passageway.

A longitudinally-extending, electrically-conductive first shielding member defines a first shielding member passageway extending longitudinally through the first shielding member with the first cavity block member slidably received and fixed in the first shielding member passageway. The first shielding member is connected to the first shield layer and a first seal is connected to the first cable. The first seal surrounds and is in contact with the first sheath. The first terminal piece is either a female terminal or a male terminal.

The receiving connector housing has a receiving forward connector housing portion and a receiving rearward connector housing portion connected to the receiving forward connector housing portion. The receiving rearward connector housing portion defines a receiving terminal assembly conduit that is sized and adapted to slidably receive and fixedly retain the first terminal assembly therein in a close fitting relationship. The receiving rearward connector housing portion has a first receiving rearward connector housing part that extends rearwardly from and exteriorly of the receiving forward connector housing portion and a second receiving rearward connector housing part that is integrally connected to the first receiving rearward connector housing part and extends forwardly into the receiving forward connector housing portion. In this manner, the receiving forward connector housing portion surrounds the second receiving rearward connector housing part. The second receiving rearward connector housing part is disposed in a spaced apart relationship from the receiving forward connector housing portion to define a receiving annular cavity between the receiving forward connector housing portion and the second receiving rearward connector housing part.

The second terminal assembly includes a second cable having an electrically-conductive second core strand, an electrically non-conductive second wire insulation that surrounds the second core strand, an electrically-conductive second shield layer that surrounds the second wire insulation and an electrically non-conductive second sheath that surrounds the second shield layer. The second terminal assembly also includes an electrically-conductive second terminal piece connected to the second core strand, a longitudinally-extending second cavity block member that defines a second cavity block member passageway extending longitudinally through the second cavity block member with the second terminal piece slidably received and fixed in the second cavity block member passageway, a longitudinally-extending, electrically-conductive second shielding member that defines a second shielding member passageway extending longitudinally through the second shielding member with the second cavity block member slidably received and fixed in the second shielding member passageway with the second shielding member connected to the second shield layer and a second seal connected to the second cable and surrounding and in contact with the second sheath. The second terminal piece is a remaining one of either the female terminal or the male terminal.

The insertable connector housing has an insertable forward connector housing portion and an insertable rearward connector housing portion connected to the insertable forward connector housing portion. The insertable rearward connector housing portion defines an insertable terminal assembly conduit sized and adapted to slidably receive and fixedly retain the second terminal assembly therein in a close fitting relationship. The insertable forward connector housing portion defines an insertable forward connector housing cavity that is in communication with the insertable terminal assembly conduit. The insertable forward connector housing portion has an insertable forward connector housing edge that defines an insertable forward connector housing opening into the insertable forward connector housing cavity. The insertable rearward connector housing portion has an insertable rearward connector housing edge that defines an insertable rearward connector housing opening that is smaller than the insertable forward connector housing opening.

The connector seal has an inner circumferential contact surface and an outer circumferential contact surface. The connector seal surrounds the second receiving rearward connector housing part in the receiving annular cavity with the inner circumferential contact surface of the connector seal in sealing contact with the second receiving rearward connector housing part.

The receiving annular cavity is sized to slidably receive the insertable forward connector housing portion so that, when the receiving and insertable connector housings are connected together, the first and second terminal pieces mate in electrical contact with one another and the connector seal is disposed in the insertable forward connector housing cavity with the outer circumferential contact surface of the connector seal in sealing contact with the insertable forward connector housing portion.

These objects and other advantages of the present invention will be better appreciated in view of the detailed description of the exemplary embodiments of the present invention with reference to the accompanying drawings, in which:

BRIEF DESCRIPTION OF THE DRAWINGS

FIG. 1 is an exploded perspective view of one exemplary embodiment of a terminal assembly of the present invention employing a male terminal piece.

FIG. 1A is a perspective view of a female terminal piece that could be employed as a substitute for the male terminal piece.

FIG. 2 is a side elevation view in cross-section of the terminal assembly of the present invention taken along line 2-2 in FIG. 6.

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

A first exemplary embodiment of a terminal assembly 10 of the present invention is hereinafter described with reference to FIGS. 1-6. As shown in these Figures, the terminal assembly 10 includes in electrical cable 12, and electrically-conductive terminal piece 14M or 14F, a longitudinally-extending cavity block member 16 and a longitudinally-extending, electrically-conductive shielding member 18 that extends along longitudinal axis L.

The cable 12 has an electrically-conductive core strand 12*a*, electrically non-conductive wire insulation 12*b* surrounding the core strand 12*a*, an electrically-conductive shield layer 12*c* surrounding the wire insulation 12*b* and an electrically non-conductive sheath 12*d* surrounding the shield layer 12*c*. The electrically-conductive terminal piece 14M or 14F is electrically connected to the core strand 12*a*. One of ordinary skill in the art would appreciate that the terminal piece 14M is a male terminal piece and the terminal piece 14F is a female terminal piece, as best shown in FIG. 1A, that matably engage with each other for electrical contact. The mateable engagement of the male and female terminal pieces 14M and 14F is referred to below.

Figure 3:
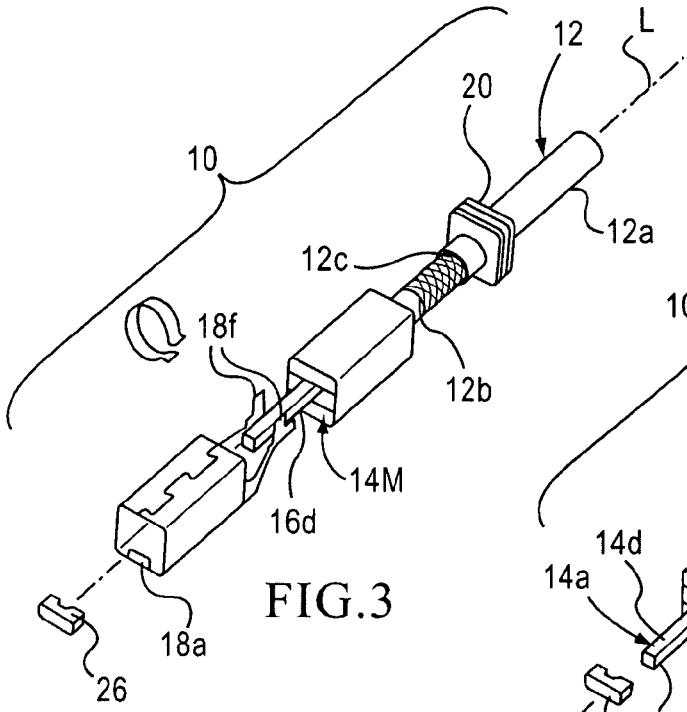
FIG. 3 is a partial exploded perspective view of the terminal assembly of the present invention with a terminal piece inserted into a cavity block member.
Figure 4:
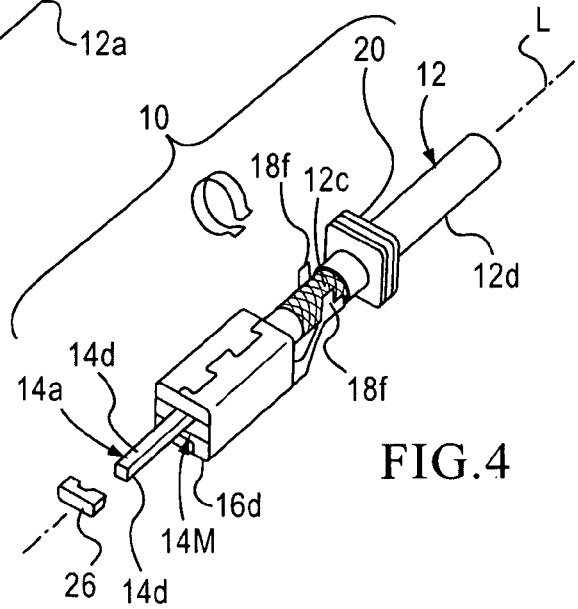
FIG. 4 is a partial exploded perspective view of the terminal assembly of the present invention with the assembled terminal piece and cavity block member inserted into a shielding member.
Figure 5:
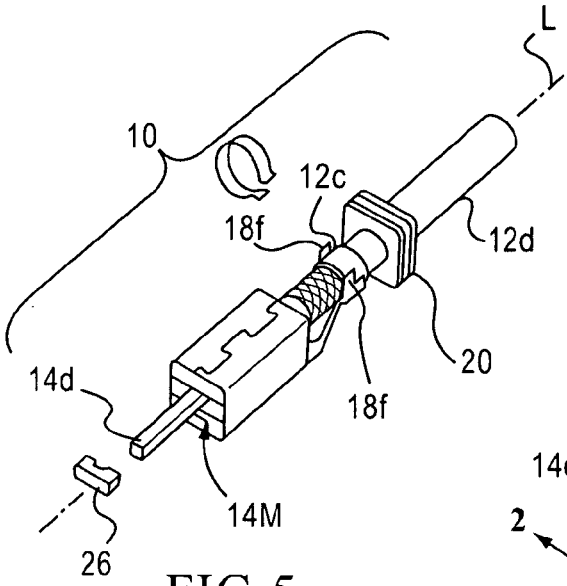
FIG. 5 is a partial exploded perspective view of the terminal assembly of the present invention with the assembled terminal piece, cavity block member and shielding member with crimping tab portions crimpted about a cable.
Figure 6:
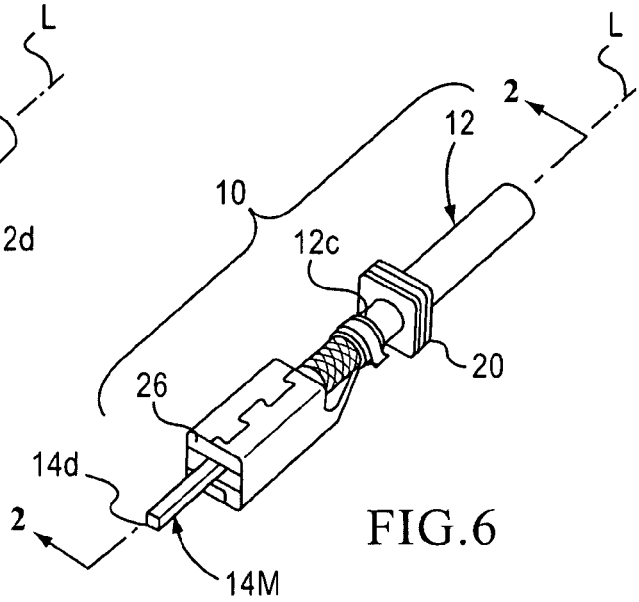
FIG. 6 is an exploded perspective view of the terminal assembly of the present invention with the assembled terminal piece, cavity block member and shielding member with crimping tab portions crimpted about a cable with a retainer inserted into the cavity block member and a ferrule crimped about the crimping tab portions.

As shown in FIG. 1, the cavity block member 16 defines a cavity block member passageway 16*a* that extends longitudinally along the longitudinal axis L through the cavity block member 16. The cavity block member passageway 16*a* is sized and adapted to slidably receive and retain the terminal piece 14 therein as shown in FIGS. 2-6. As illustrated in FIGS. 1 and 3, the shielding member 18 defines a shielding member passageway 18*a* that extends longitudinally along the longitudinal axis L through the shielding member 18. With reference to FIGS. 2 and 4-6, the shielding member passageway 18*a* is sized to slidably receive the cavity block member 16. Further, as best illustrated in FIGS. 4-6, the shielding member 18 connected to the shield layer 12*c*.

Also, as shown in FIGS. 1-6, the terminal assembly 10 also includes a seal 20. The seal 20 is connected to cable 12. Also, the seal 20 surrounds the cable and is in sealing contact with the sheath 12*d*.

As best shown in FIGS. 1 and 2, the terminal piece 14M or 14F includes a box-shaped terminal piece portion 14*a* and a terminal piece crimping portion 14*b*. The box-shaped terminal piece portion 14*a* is forwardly disposed and the terminal piece crimping portion 14*b* is rearwardly disposed relative to each other. The terminal piece crimping portion 14*b* is integrally connected to the terminal piece portion 14*a*. Also, the terminal piece crimping portion 14*b* has terminal piece crimping tab portions 14*c*. As best shown in FIG. 1, the terminal piece crimping tab portions 14*c* are connected to and surround the core strand in a crimped manner.

If the terminal piece 14 is a male terminal, i.e. 14M, the male terminal 14M has a prong 14*d* that projects forwardly of the terminal piece portion 14*a* along the longitudinal axis L. If the terminal piece 14 is a female terminal, i.e., 14F, the female terminal 14F has a spring element 14*e* that is disposed internally of the terminal piece portion 14*a*. Although not by way of limitation, the box-shaped terminal piece portion 14*a* of the male terminal piece 14M might be a solid piece having a recess 14*f* formed into an upper surface of the solid terminal piece portion 14*a*. Again, although not by way of limitation, the box-shaped terminal piece portion 14*a* of the female terminal piece 14F might be a pair of parallel plates 14*f* connected to each other by a base plate 14*h*. One of the pair of parallel plates 14*f* has a hole 14*j* formed therethrough while a remaining one of the pair of parallel plates 14*f* has a raised platform 14*k* that opposed the spring element 14*e*.

For illustration purposes only of the first exemplary embodiment of the terminal assembly 10 of the present invention, the male terminal piece 14M will be illustrated although a skilled artisan would appreciate that the female terminal piece 14F may be easily substituted therefor.

For the first exemplary embodiment of the terminal assembly 10 of the present invention, the cavity block member 16 is a rectangularly-shaped tube as shown in FIGS. 1 and 3-6 that has two pairs of opposing cavity block member side walls 16*a* and 16*b*. Also, the cavity block member 16 includes a plateau 16*d* that disposed in the cavity block member passageway 16*a* and is connected to at least one of the cavity block member side walls 16*b* or 16*c*. As illustrated from FIG. 3 to FIGS. 4-6, the terminal piece 14M is slidably received in the cavity block member passageway 16*a* and the terminal piece 14M contacts the plateau 16*d* and extends between one pair of opposing cavity block member side walls 16*b*.

As that shown in FIG. 1, the shielding member 18 includes a forwardly-disposed rectangularly-shaped shielding member tube portion 18*b* having two pairs of opposing shielding member side walls 18*c* and 18*d* and a rearwardly-disposed shielding member crimping portion 18*e*. The shielding member crimping portion 18*e* is integrally formed with the shielding member tube portion 18*b*. The shielding member crimping portion 18*e* has shielding member crimping tab portions 18*f* that are connected to and surrounding the shield layer 12*c* in a crimped manner as best shown in FIGS. 4-6.

To assure connection of the shielding member crimping tab portions 18*f* to the shielding layer 12*c*, a ferrule 22 is connected to and surrounds the shielding member crimping portion 18*e* and particularly surrounds the shielding member crimping tab portions 18*f* shown in FIG. 6.

As that shown in FIGS. 1 and 2, the cavity block member 16 includes a lance member 24 is disposed in the cavity block member passageway 16*a*. The lance member 24 is connected to the cavity block member 16 in a cantilever manner as best illustrated in FIG. 2. In FIG. 2, the lance member 24 has a rearward end portion 24*a* connected to the cavity block member 16 and a free forward end portion 24*b*. The free forward end portion 24*b* is disposed apart from the cavity block member 16 to form a gap G therebetween. The free forward end portion 24*b* has a lock projection 24*c*. The lance member 24 is operative to move to and between a lock state (drawn as solid lines in FIG. 2) away from the cavity block member 16 and a flexed state (phantomly drawn in FIG. 2) toward the cavity block member 16. And, the lance member 24 is resiliently biased towards the lock state. Further, as mentioned above, the box-shaped terminal piece portion 14*a* includes either the recess 14*f* for the male terminal piece 14M or the hole formed 14*j* for the female terminal piece 14F. The respective recess 14*f* or the hole 14*j* is sized to receive the lock projection 24*c* in a close-fitting manner so as to prevent relative movement between the terminal piece 14M or 14F and the cavity block member 16 when the terminal piece 14M or 14F is slidably received by the cavity block member passageway 16*a*.

Additionally, as best shown in FIG. 2, a retainer element 26 is sized to be slidably received by the gap G. When the retainer element 26 is received by the gap G, the retainer element 26 prevents the lance member from moving from the lock state to the flexed state.

Figure 7:
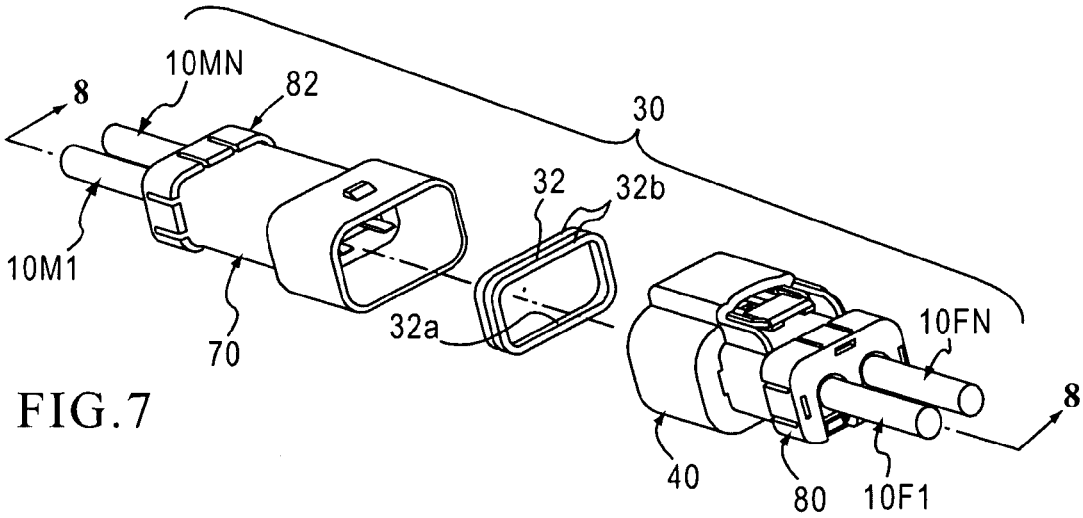
FIG. 7 is an exploded perspective view of another exemplary embodiment of a sealed electrical connector of the present invention.
Figure 8:
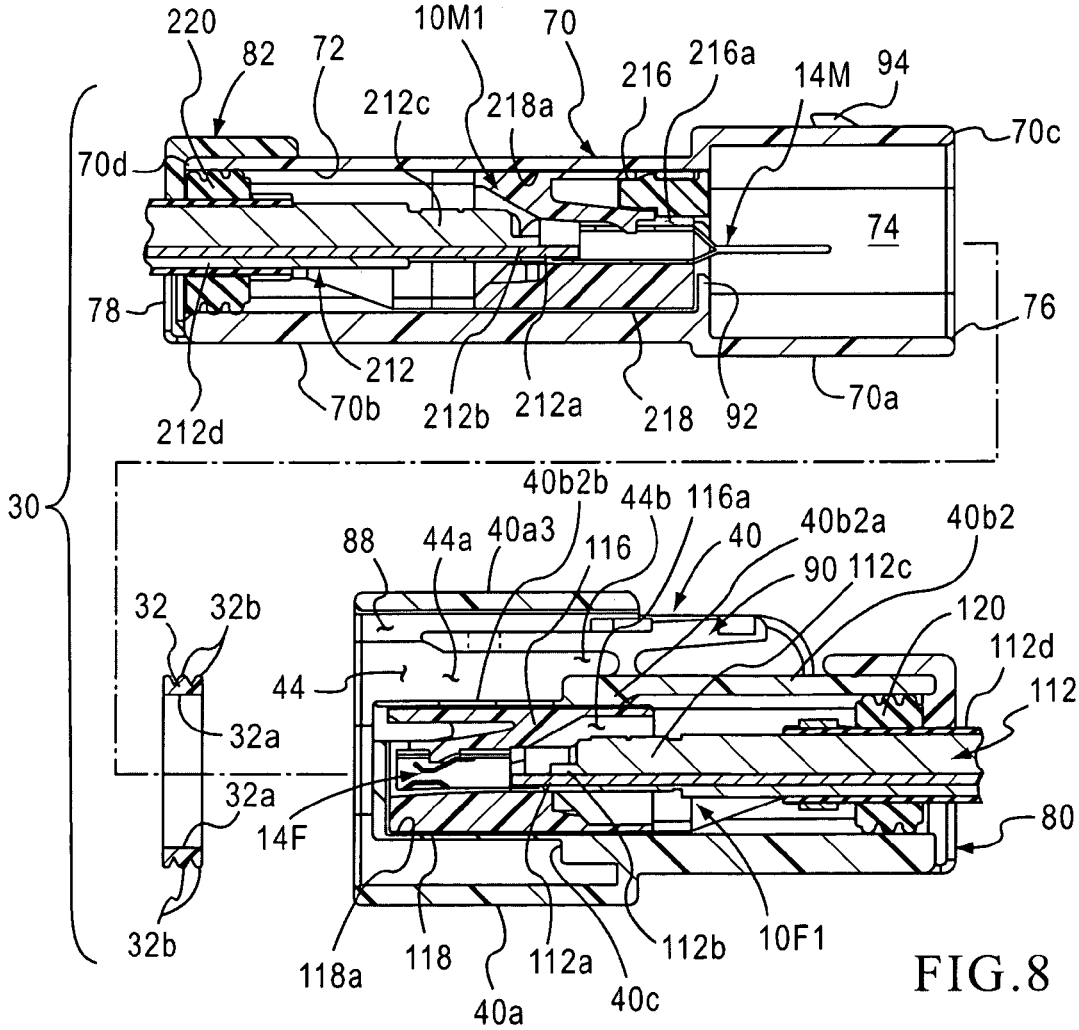
FIG. 8 is a side elevation view in cross-section of the sealed electrical connector of the present invention taken along line 8-8 in FIG. 7.
Figure 9:
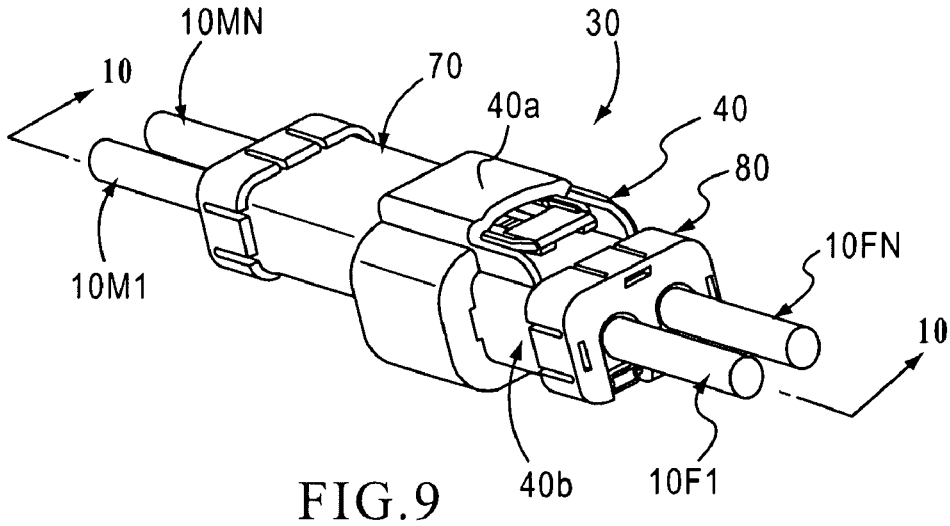
FIG. 9 is a perspective view of the sealed electrical connector of the present invention shown in FIG. 7 connected together.

With regard to FIGS. 7-10, another exemplary embodiment of the present invention is a sealed electrical connector 30 of the present invention that utilizes two mating terminal assemblies 10 as described above. One of ordinary skill in the art would appreciate that one of the two mating terminal assemblies 10 would include a male terminal piece 14M and a remaining one of the two mating terminal assemblies 10 would include a female terminal piece 14F as discussed above. The sealed electrical connector 30 includes at least one female terminal assembly 10F1 or two or more female terminal assemblies 10F1-10FN as represented in FIGS. 7 and 9 and at least one male terminal assembly 10M1 or two or more male terminal assemblies 10M1-10MN as represented in FIGS. 7 and 9. However, for simplicity of explanation, the following description of the sealed electrical connector 30 will be discussed as if only one female terminal assembly 10F1 and only one male terminal assembly 10M1 are employed although a skilled artisan would appreciate that two or more male and female terminal assemblies can be employed without departing from the spirit and inventive concepts of the invention.

Additionally, the sealed electrical connector 30 includes a connector seal 32, a "receiving" connector housing 40 that fixedly receives the female terminal assembly 10F1 and an "insertable" connector housing 70. One of ordinary skill in the art appreciates that many electrical connectors include a "first" one-half connector that connects to a "second" one-half connector by virtue of the "first" one-half connector slidably receiving the "second" one-half connector that is inserted into the "first" one-half connector. However, rather than using non-descriptive words such as "first" and "second", the terms "receiving" and "insertable" may be used, as appropriate, as substitutes for the non-descriptive words for ease of reading and understanding which one-half connector is being described.

In FIGS. 7-10, the sealed electrical connector 30 includes a female terminal assembly 10F1, the receiving connector housing 40, a male terminal assembly 10M1, the insertable connector housing 70 and the connector seal 32. The female terminal assembly 10F1 includes a first cable 112 that has an electrically-conductive first core strand 112*a*, electrically non-conductive first wire insulation 112*b* surrounding the first core strand 112*a*, an electrically-conductive first shield layer 112*c* surrounding the first wire insulation 112*b* and an electrically non-conductive first sheath 112*d* surrounding the first shield layer 112*c*, an electrically-conductive female terminal piece 14F connected to the first core strand 112*a*, a longitudinally-extending first cavity block member 116 defining a first cavity block member passageway 116*a* extending longitudinally through the first cavity block member 116 with the female terminal piece 14F slidably received and fixed in the first cavity block member passageway 116*a*, a longitudinally-extending, electrically-conductive first shielding member 118 defining a first shielding member passageway 118*a* extending longitudinally through the first shielding member 118 with the first cavity block member 116 slidably received and fixed in the first shielding member passageway 118*a*. Also, the first shielding member 118 is connected to the first shield layer 112*c*. Further, a first seal 120 is connected to the first cable 112 and surrounds and is in contact with the first sheath 112*d*.

Figure 11:
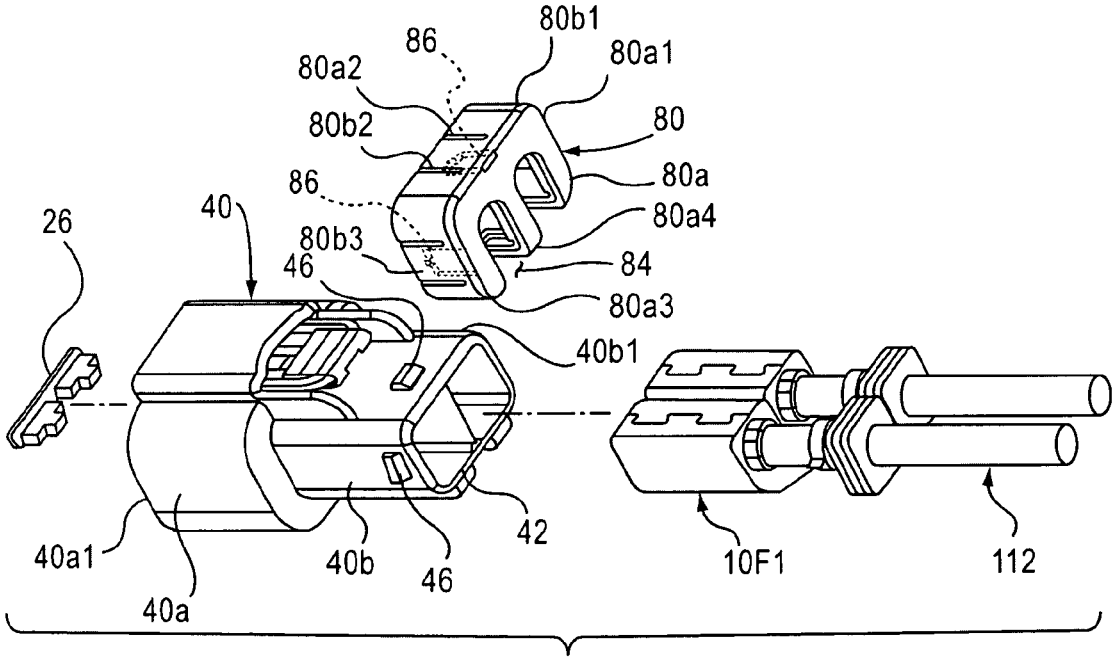
FIG. 11 is an exploded perspective view of a receiving connector housing which is a component of the sealed electrical connector in FIG. 7.

As best shown in FIGS. 11-15, the receiving connector housing 40 has a receiving forward connector housing portion 40*a* and a receiving rearward connector housing portion 40*b* connected to the receiving forward connector housing portion 40*a*. As best shown in FIG. 11, the receiving rearward connector housing portion 40*b* defines a receiving terminal assembly conduit 42 that is sized and adapted to slidably receive and fixedly retain the female terminal assembly 10F1 therein in a close fitting relationship. The receiving rearward connector housing portion 40*b* has a first receiving rearward connector housing part 40*b*1 that extends rearwardly from and exteriorly of the receiving forward connector housing portion 40*a* and a second receiving rearward connector housing part 40*b*2 that is integrally connected to the first receiving rearward connector housing part 40*b*1 and extends forwardly into the receiving forward connector housing portion 40*a*. By this arrangement, the receiving forward connector housing portion 40*a* surrounds the second receiving rearward connector housing part 40*b*2. The second receiving rearward connector housing part 40*b*2 is disposed in a spaced apart relationship from the receiving forward connector housing portion 40*a* to define a receiving annular cavity 44 between the receiving forward connector housing portion 40*a* and the second receiving rearward connector housing part 40*b*2.

Again, with reference to FIGS. 8 and 16-19, the male terminal assembly 10M1 includes a second cable 212 having an electrically-conductive second core strand 212*a*, electrically non-conductive second wire insulation 212*b* surrounding the second core strand 212*a*, an electrically-conductive second shield layer 212*c* surrounding the second wire insulation 212*b* and an electrically non-conductive second sheath 212*d* surrounding the second shield layer 212*c*, an electrically-conductive male terminal piece 14M (FIG. 19) connected to the second core strand 212*a*, a longitudinally-extending second cavity block member 216 defining a second cavity block member passageway 216*a* extending longitudinally through the second cavity block member 216 with the male terminal piece 14M slidably received and fixed in the second cavity block member passageway 216*a*, a longitudinally-extending, electrically-conductive second shielding member 218 defining a second shielding member passageway 218*a* extending longitudinally through the second shielding member 218. The second cavity block member 216 is slidably received and fixed in the second shielding member passageway 218*a* and the second shielding member 218 is connected to the second shield layer 212*c*. Also, a second seal 220 is connected to the second cable 212. The second seal 220 surrounds and is in contact with the second sheath 212*d*.

Figure 16:
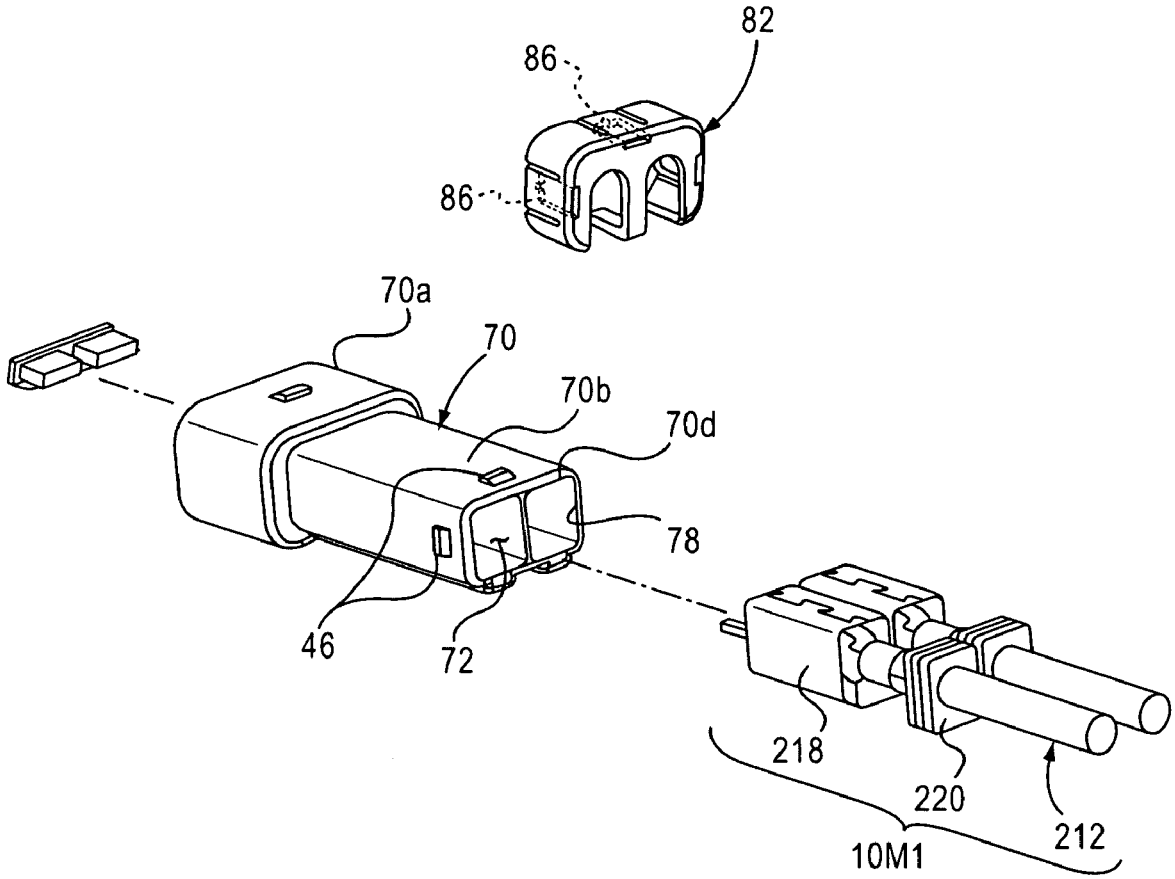
FIG. 16 is an exploded perspective view of an insertable connector housing which is a component of the sealed electrical connector in FIG. 7.
Figure 17:
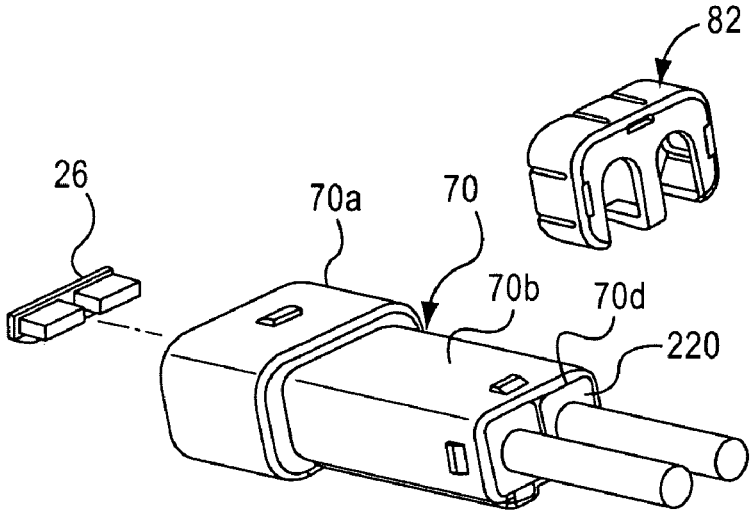
FIG. 17 is a partial exploded perspective view of the insertable connector housing in FIG. 11 with the terminal assemblies connected thereto and with an insertable seal cover and a retainer element disposed apart therefrom.
Figure 18:
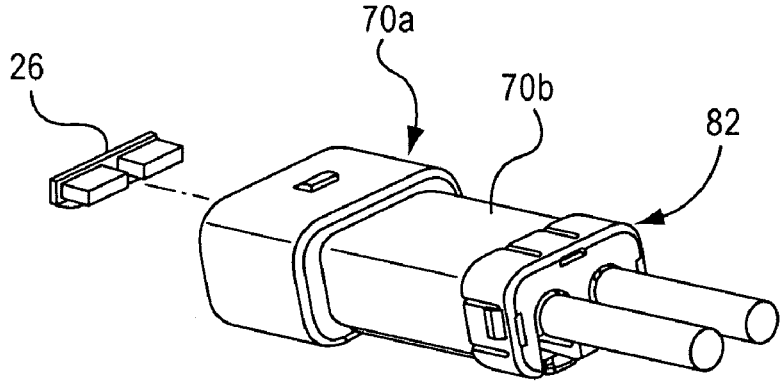
FIG. 18 is a partial exploded perspective view of the insertable connector housing in FIG. 11 with the terminal assemblies and the insertable seal cover connected thereto with the retainer element disposed apart therefrom.
Figure 19:
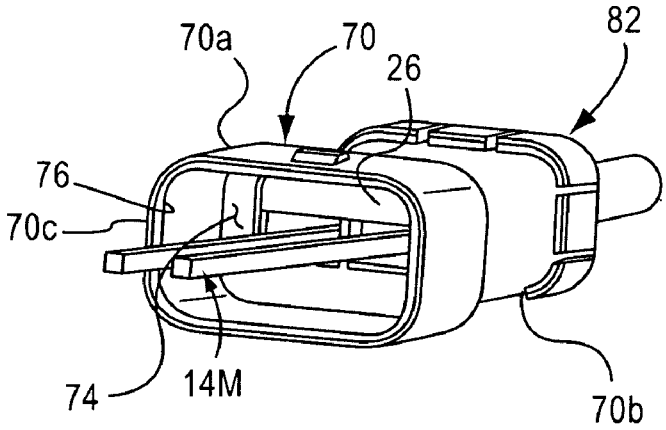
FIG. 19 is perspective view of the insertable connector housing in FIG. 11 completely assembled.

Again, with reference to FIGS. 8 and 16-19, the insertable connector housing 70 has an insertable forward connector housing portion 70*a* and an insertable rearward connector housing portion 70*b* that is integrally connected to the insertable forward connector housing portion 70*a*. The insertable rearward connector housing portion 70*b* defines an insertable terminal assembly conduit 72, as best shown in FIG. 16, that is sized and adapted to slidably receive and fixedly retain the male terminal assembly 10M therein in a close fitting relationship. The insertable forward connector housing portion 70*a* defines an insertable forward connector housing cavity 74 that is in communication with the insertable terminal assembly conduit 72. The insertable forward connector housing portion 70*a* has an insertable forward connector housing edge 70*c* that defines an insertable forward connector housing opening 76 into the insertable forward connector housing cavity 74. The insertable rearward connector housing portion 70*b* has an insertable rearward connector housing edge 70*d* that defines an insertable rearward connector housing opening 78 that is smaller than the insertable forward connector housing opening 76.

Figure 10:
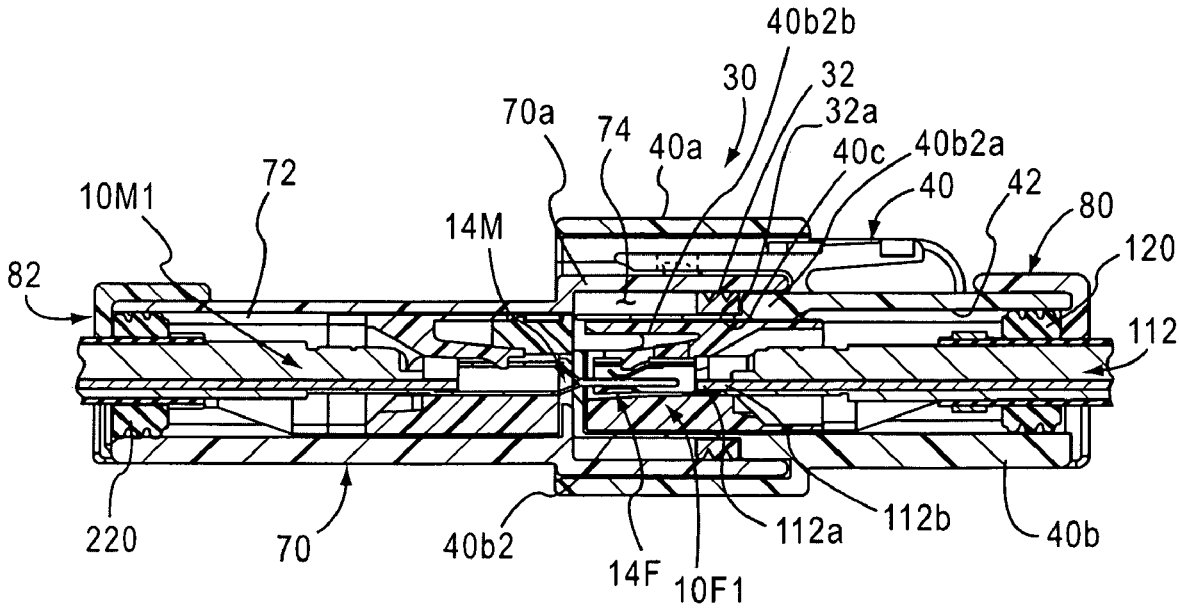
FIG. 10 is a side elevation view in cross-section of the sealed electrical connector of the present invention taken along line 10-10 in FIG. 9.

As a shown in FIGS. 7 and 8, the connector seal 32 has an inner circumferential contact surface 32*a* and an outer circumferential contact surface 32*b*. As shown in FIG. 10, the connector seal 32 surrounds the second receiving rearward connector housing part 40*b*2 in the receiving annular cavity 44 (FIG. 8) and the inner circumferential contact surface 32*a* of the connector seal 32 is in sealing contact with the second receiving rearward connector housing part 40*b*2.

With reference to FIGS. 8 and 10, the receiving annular cavity 44 is sized to slidably receive the insertable forward connector housing portion 70*a* so that, when the receiving connector housing 40 and insertable connector housing 70 are connected together (FIG. 10), the female terminal piece 14F and male terminal piece 14M mate in electrical contact with one another. Further, the connector seal 32 is disposed in the insertable forward connector housing cavity 74 (FIG. 10) and the outer circumferential contact surface 32*b* of the connector seal 32 is in sealing contact with the insertable forward connector housing portion 70*a*.

In FIGS. 7-19, the sealed electrical connector 30 includes a receiving seal cover 80 and an insertable seal cover 82. The receiving seal cover 80 is releasably connected to the receiving rearward connector housing portion 40*b* and, when connected, is in contact with the first seal 120 disposed within the receiving terminal assembly conduit 42. The insertable seal cover 82 is releasably connected to the insertable rearward connector housing portion 70*b* and is in contact with the second seal 220 disposed within the insertable terminal assembly conduit 72.

Figure 12:
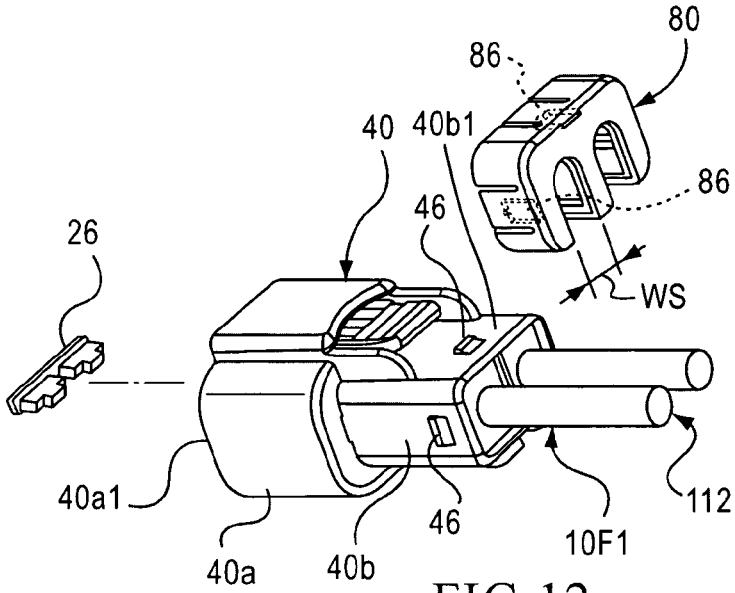
FIG. 12 is a partial exploded perspective view of the receiving connector housing in FIG. 11 with the terminal assemblies connected thereto and with a receiving seal cover and a retainer element disposed apart therefrom.
Figure 13:
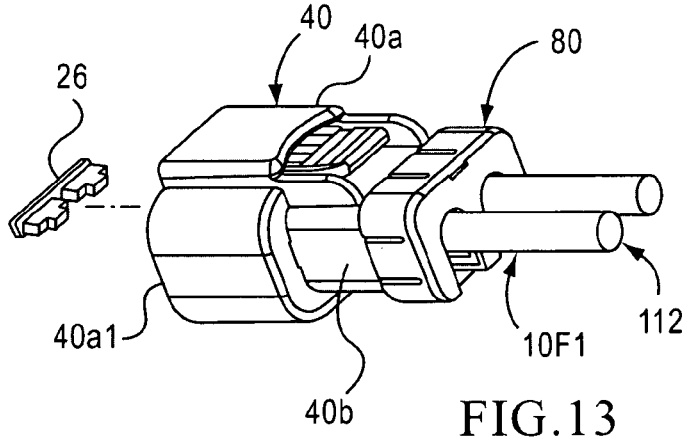
FIG. 13 is a partial exploded perspective view of the receiving connector housing in FIG. 11 with the terminal assemblies and the receiving seal cover connected thereto with the retainer element disposed apart therefrom.

The receiving seal cover 80 and the insertable seal cover 82 are identical structures. Therefore, only the receiving seal cover 80 shall be described hereinafter. As best shown in FIGS. 11 and 12, the receiving seal cover 80 includes a generally-rectangular base wall 80*a* that has a first side edge 80*a*1, a second side edge 80*a*2, a third side edge 80*a*3 and a fourth side edge segment 80*a*4. The first side edge 80*a*1, the second side edge 80*a*2 and the third side edge 80*a*3 are serially connected together. The receiving seal cover 80 also includes threes side walls 80*b*1, 80*b*2 and 80*b*3 that are connected serially to each other and connected perpendicularly to base wall 80*a* and along respective ones of the first, second and third side edges 80*a*1, 80*a*2 and 80*a*3. The base wall 80*a* has at least one slot 84 formed therethrough and commences adjacent to the fourth side edge segment 80*a*4 and extends towards the second side edge 80*a*2. The slot 84 has a slot width Ws (FIG. 12) sized to receive the 112 cable.

As best shown in FIGS. 11 and 12, the receiving rearward connector housing portion 40*b* is a generally rectangularly-shaped tube and includes a plurality of stop elements 46 although one of ordinary skill in the art would appreciate that the receiving rearward connector housing portion 40*b* would have at least one stop element 46. Each one of the one stop elements 46 is connected exteriorly of receiving rearward connector housing portion 40*b* and projects away from the receiving terminal assembly conduit 42. Further, at least one of the three side walls includes a recess 86. The recess is sized and positioned to receive the stop element 46 in order to releasably retain the receiving seal cover 80 to the rearward connector housing portion 40*b*.

As shown in FIG. 16, the insertable rearward connector housing portion 70*b* also includes stop elements 46 arranged thereon as discussed above for the receiving rearward connector housing portion 40*b*. Therefore, no further discussion is deemed necessary.

Again, with reference to FIGS. 8 and 10, the receiving annular cavity 44 has an enlarged receiving annular cavity portion 44*a* and a reduced receiving annular cavity portion 44*b* that is in communication with the enlarged receiving annular cavity portion 44*a*. The second receiving rearward connector housing part 40*b*2 of the receiving rearward connector housing portion 40*b* includes an enlarged receiving rearward connector housing part portion 40*b*2*a* and a reduced receiving rearward connector housing part portion 40*b*2*b* that extends forwardly of the enlarged receiving rearward connector housing part portion 40*b*2*a*. Note that a stepped down wall 40*c* delineates the enlarged receiving rearward connector housing part portion 40*b*2*a* and the reduced second receiving rearward connector housing part portion 40*b*2*b*. The enlarged receiving rearward connector housing part portion 40*b*2*a* defines, in part, the reduced receiving annular cavity portion 44*a* and the reduced receiving rearward connector housing part portion 40*b*2*b* defines, in part, the enlarged receiving annular cavity portion 44*b*.

Figure 14:
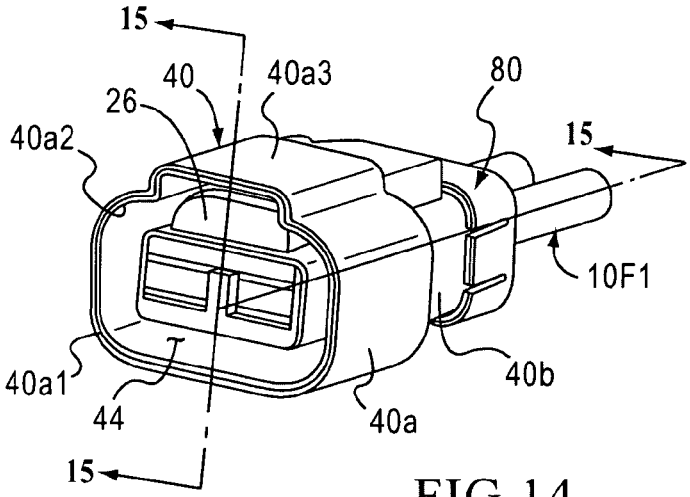
FIG. 14 is perspective view of the receiving connector housing in FIG. 11 completely assembled.
Figure 15:
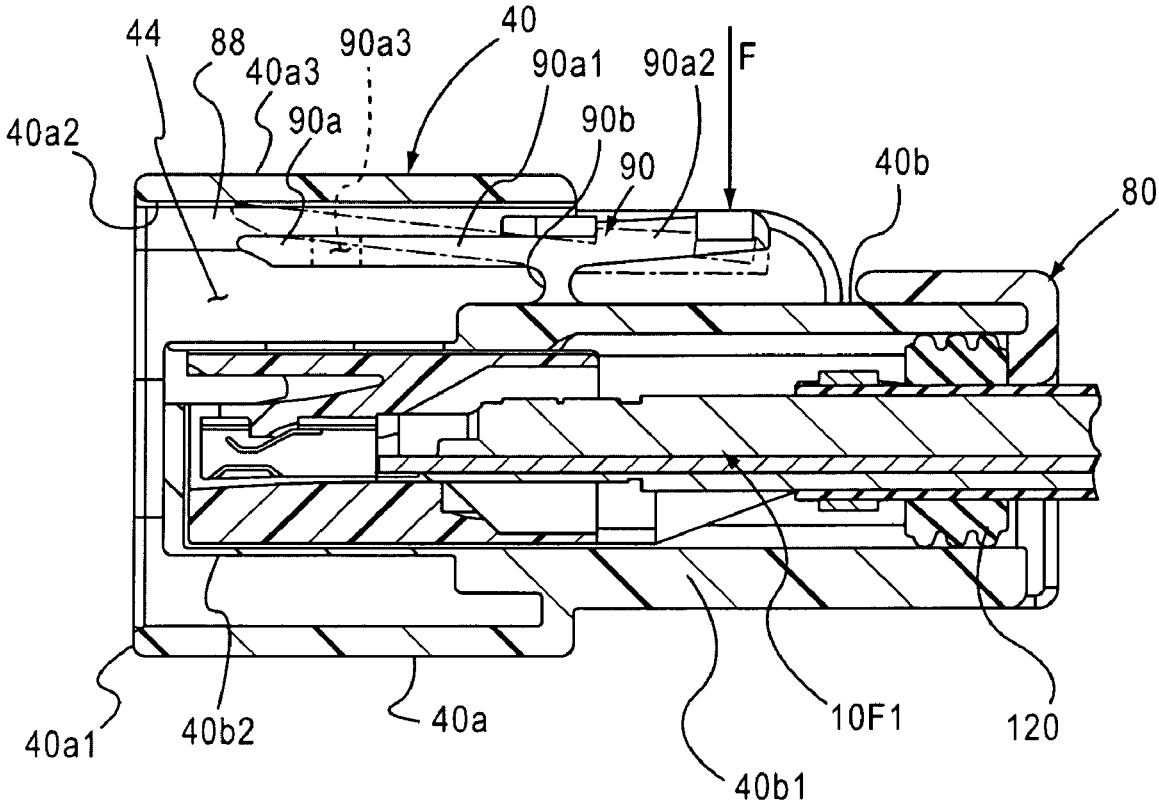
FIG. 15 is a side elevation view in cross-section of the receiver connector housing taken along line 15-15-15 and FIG. 14.

In FIGS. 11-15, the receiving forward connector housing portion 40*a* is a receiving forward connector housing circumferential wall that has a receiving forward circumferential peripheral edge 40*a*1 (as best shown in FIGS. 14 and 15). With reference to FIG. 14, the receiving forward circumferential peripheral edge 40*a*1 defines a receiving opening 40*a*2 into the receiving annular cavity 44. Note in FIG. 15, that the second receiving rearward connector housing part 40*b*2 is disposed in the receiving annular cavity 44 and is disposed apart from the receiving opening 40*a*2. The receiving forward connector housing portion 40*a* as the receiving forward connector housing circumferential wall includes a receiving raised circumferential wall portion 40*a*3 that defines a latch cavity 88 as best shown in FIGS. 8 and 15. The latch cavity 88 is in communication with the receiving annular cavity 44 and extends through the receiving forward connector housing portion 40*a*.

As shown in FIGS. 8 and 15, a latch mechanism 90 is disposed partially within the latch cavity 88 and is connected to the receiving connector housing 40. With reference to FIG. 15, the latch mechanism 90 has a lever member 90*a* that has a forward lever portion 90*a*1 disposed in the latch cavity 88 and a rearward lever portion 90*a*2 that is integrally connected to the forward lever portion 90*a*1 and that extends outwardly from the latch cavity 88. The lever member 90*a* has a lock mechanism projection hole 90*a*3 formed therethrough. The latch mechanism 90 includes a fulcrum element 90*b* that is connected to and between the lever member 90*a* and the receiving rearward connector housing portion 40*b*. The fulcrum element 90*b* is disposed at an interface of the forward lever portion 90*a*1 and the rearward lever portion 90*a*2. As shown in FIG. 15, the lever member 90*a* moves to and between a normally relaxed condition (drawn in solid lines) and a flexed condition (drawn in phantom). Upon pressing the rearward lever portion 90*a*2 with a sufficient force F towards the receiving rearward connector housing portion 40*b* when the lever member 90*a* is in the normally relaxed condition, the forward lever portion 90*a*1 moves toward the receiving raised circumferential wall portion 40*a*3. The lever member 90*a* is resiliently biased to the normally relaxed condition.

In FIG. 8, the insertable connector housing 70 includes a stop wall 92. The stop wall 92 is disposed in the insertable terminal assembly conduit 72 adjacent the insertable forward connector housing cavity 74. The stop wall is operative to prevent the male terminal assembly 10M1 to move into the insertable forward connector housing cavity 74.

Also, in FIG. 8, the insertable forward connector housing portion 70*a* includes a lock mechanism projection 94 that is connected exteriorly of the insertable forward connector housing portion 70*a* and projects away from the insertable forward connector housing cavity 74. One of ordinary skill in the art would comprehend that upon connecting the receiving connector housing 40 and the insertable connector housing 70 together, as shown in FIG. 10, the lock mechanism projection hole 90*a*3 captures the lock mechanism projection 94 thus releasably locking the receiving connector housing 40 and the insertable connector housing 70 together.

Furthermore, although the preceding description of the exemplary embodiment of the sealed electrical connector 30 refers to the receiving connector assembly as having a female terminal assembly and the insertable connector assembly as having the male terminal assembly, one of ordinary skill in the art would appreciate that the receiving connector assembly might have the male terminal assembly while the insertable connector assembly might have the female terminal assembly.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A receiving connector assembly, comprising:

a terminal assembly including a cable having an electrically-conductive core strand, electrically non-conductive wire insulation surrounding the core strand, an electrically-conductive shield layer surrounding the wire insulation and an electrically non-conductive sheath surrounding the shield layer, an electrically-conductive terminal piece connected to the core strand, a longitudinally-extending cavity block member defining a cavity block member passageway extending longitudinally through the cavity block member with the terminal piece slidably received and fixed in the cavity block member passageway, a longitudinally-extending, electrically-conductive shielding member defining a shielding member passageway extending longitudinally through the shielding member with the cavity block member slidably received and fixed in the shielding member passageway with the shielding member connected to the shield layer and a seal connected to the cable and surrounding and in contact with the sheath; and a connector housing having a forward connector housing portion and a rearward connector housing portion connected to the forward connector housing portion, the rearward connector housing portion defining a terminal assembly conduit sized and adapted to slidably receive and fixedly retain the terminal assembly therein in a close fitting relationship, the rearward connector housing portion having a first rearward connector housing part extending rearwardly from and exteriorly of the forward connector housing portion and a second rearward connector housing part integrally connected to the first rearward connector housing part and extending forwardly into the forward connector housing portion such that the forward connector housing portion surrounds the second rearward connector housing part, the second rearward connector housing part being disposed in a spaced apart manner from the forward connector housing to define an annular cavity between the forward connector housing portion and the second rearward connector housing part.

2. A receiving connector assembly according to claim 1, wherein the forward connector housing portion includes a forward connector housing circumferential wall having a forward circumferential peripheral edge defining an opening into the annular cavity, the second rearward connector housing part being disposed in the annular cavity and apart from the opening.

3. A receiving connector assembly according to claim 2, wherein the forward connector housing circumferential wall includes a raised circumferential wall portion defining a latch cavity in communication with the annular cavity, the latch cavity extending through the forward connector housing portion.

4. A receiving connector assembly according to claim 3, further comprising a latch mechanism connected to the connector housing and having a lever member with a forward lever portion disposed in the latch cavity and a rearward lever portion integrally connected to the forward lever portion extending outwardly from the latch cavity.

5. A receiving connector assembly according to claim 4, wherein the latch mechanism includes a fulcrum element connected to and between the lever member and the rearward connector housing portion such that the fulcrum element is disposed at an interface of the forward lever portion and the rearward lever portion, the lever member movable between a normally relaxed condition and a flexed condition such that, upon pressing the rearward lever portion with a sufficient force towards the rearward connector housing when the lever member is in the normally relaxed condition, the forward lever portion moves toward the raised circumferential wall portion, the lever member being resiliently biased to the normally relaxed condition.

6. A receiving connector assembly according to claim 5, wherein the terminal piece includes a forwardly-disposed box-shaped terminal piece portion and a rearwardly-disposed terminal piece crimping portion integrally connected to the terminal piece portion, the terminal piece crimping portion having terminal piece crimping tab portions connected to and surrounding the core strand in a crimped manner, the terminal piece being one of a male terminal and a female terminal, the male terminal having a prong projecting forwardly of the terminal piece portion and the female terminal having a spring element disposed internally of the terminal piece portion.

7. A receiving connector assembly according to claim 1, wherein the annular cavity has an enlarged annular cavity portion and a reduced annular cavity portion in communication with the enlarged annular cavity portion and the second rearward connector housing part of the rearward connector housing includes an enlarged second rearward connector housing part portion and a reduced second rearward connector housing part portion extending forwardly of the enlarged second rearward connector housing part portion with a stepped down wall delineating the enlarged second rearward connector housing part portion and the reduced second rearward connector housing part portion, the enlarged second rearward connector housing part portion defining, in part, the reduced annular cavity portion and the reduced second rearward connector housing part portion defining, in part, the enlarged annular cavity portion.

8. A receiving connector assembly according to claim 1, further comprising a seal cover releasably connected to the rearward connector housing portion and in contact with the seal disposed within the terminal assembly conduit.

9. A receiving connector assembly according to claim 8, wherein the seal cover includes a generally-rectangular base wall and three side walls, the base wall having a first side edge, a second side edge, a third side edge and a fourth side edge segment, the first side edge, the second side edge and the third side edge being serially connected together, the three side walls connected serially to each other and connected perpendicularly to base wall along respective ones of the first, second and third side edges, the base wall having a slot formed therethrough and commencing adjacent the fourth side edge segment and extending towards the second side edge, the slot sized to receive the cable.

10. A receiving connector assembly according to claim 9, wherein the rearward connector housing portion is a generally rectangularly shaped tube having at least one stop element connected exteriorly thereof and projecting away from the terminal assembly conduit, at least one of the three side walls includes a recess sized and positioned to receive the stop element to releasably retain the seal cover to the rearward connector housing portion.

11. A receiving connector assembly according to claim 1, wherein the cavity block member includes a lance member disposed in the cavity block member passageway and connected to the cavity block member in a cantilever manner, the lance member having a rearward end portion connected to the cavity block member and a free forward end disposed apart from the cavity block member to form a gap therebetween, the free forward end having a lock projection, the lance member operative to move to and between a lock state in which the lance member is disposed away from the cavity block member and a flexed state in which the lance member is disposed toward the cavity block member, the lance member being resiliently biased towards the lock state.

12. A receiving connector assembly according to claim 11, further comprising a retainer element sized to be slidably received by the gap and operative, when received by the gap, to prevent the lance member from moving from the lock state to the flexed state.

13. An insertable connector assembly, comprising:

a terminal assembly including a cable having an electrically-conductive core strand, electrically non-conductive wire insulation surrounding the core strand, an electrically-conductive shield layer surrounding the wire insulation and an electrically non-conductive sheath surrounding the shield layer, an electrically-conductive terminal piece connected to the core strand, a longitudinally-extending cavity block member defining a cavity block member passageway extending longitudinally through the cavity block member with the terminal piece slidably received and fixed in the cavity block member passageway, a longitudinally-extending, electrically-conductive shielding member defining a shielding member passageway extending longitudinally through the shielding member with the cavity block member slidably received and fixed in the shielding member passageway with the shielding member connected to the shield layer and a seal connected to the cable and surrounding and in contact with the sheath; and a connector housing having a forward connector housing portion and a rearward connector housing portion connected to the forward connector housing portion, the rearward connector housing portion defining a terminal assembly conduit sized and adapted to slidably receive and fixedly retain the terminal assembly therein in a close fitting relationship, the forward connector housing portion defining a forward connector housing cavity being in communication with the terminal assembly conduit, the forward connector housing portion having a forward connector housing edge defining a forward connector housing opening into the forward connector housing cavity, the rearward connector housing portion having a rearward connector housing edge defining a rearward connector housing opening being smaller than the forward connector housing openings, wherein the cavity block member includes a lance member disposed in the cavity block member Passageway and connected to the cavity block member in a cantilever manner, the lance member having a rearward end portion connected to the cavity block member and a free forward end disposed apart from the cavity block member to form a gap therebetween, the free forward end having a lock projection, the lance member operative to move to and between a lock state in which the lance member is disposed away from the cavity block member and a flexed state in which the lance member is disposed toward the cavity block member, the lance member being resiliently biased towards the lock state.

14. An insertable connector assembly according to claim 13, wherein the connector housing includes a stop wall disposed in the terminal assembly conduit and adjacent the forward connector housing cavity, the stop wall is operative to prevent the terminal assembly to move into the forward connector housing cavity.

15. An insertable connector assembly according to claim 13, wherein the forward connector housing portion includes a lock mechanism projection connected exteriorly of the forward connector housing portion and projecting away from the forward connector housing cavity.

16. An insertable connector assembly according to claim 15, further comprising a seal cover releasably connected to the rearward connector housing portion and in contact with the seal disposed within the terminal assembly conduit.

17. An insertable connector assembly according to claim 13, further comprising a retainer element sized to be slidably received by the gap and operative, when received by the gap, to prevent the lance member from moving from the lock state to the flexed state.

18. An insertable connector assembly comprising:

a terminal assembly including a cable having an electrically-conductive core strand, electrically non-conductive wire insulation surrounding the core strand, an electrically-conductive shield layer surrounding the wire insulation and an electrically non-conductive sheath surrounding the shield layer, an electrically-conductive terminal piece connected to the core strand, a longitudinally-extending cavity block member defining a cavity block member passageway extending longitudinally through the cavity block member with the terminal piece slidably received and fixed in the cavity block member passageway, a longitudinally-extending, electrically-conductive shielding member defining a shielding member Passageway extending longitudinally through the shielding member with the cavity block member slidably received and fixed in the shielding member passageway with the shielding member connected to the shield layer and a seal connected to the cable and surrounding and in contact with the sheath;

a connector housing having a forward connector housing portion and a rearward connector housing portion connected to the forward connector housing portion, the rearward connector housing portion defining a terminal assembly conduit sized and adapted to slidably receive and fixedly retain the terminal assembly therein in a close fitting relationship, the forward connector housing portion defining a forward connector housing cavity being in communication with the terminal assembly conduit, the forward connector housing portion having a forward connector housing edge defining a forward connector housing opening into the forward connector housing cavity, the rearward connector housing portion having a rearward connector housing edge defining a rearward connector housing opening being smaller than the forward connector housing opening; and a seal cover releasably connected to the rearward connector housing portion and in contact with the seal disposed within the terminal assembly conduit, wherein the seal cover includes a generally-rectangular base wall and three side walls, the base wall having a first side edge, a second side edge, a third side edge and a fourth side edge segment, the first side edge, the second side edge and the third side edge being serially connected together, the threes side walls connected serially to each other and connected perpendicularly to base wall along respective ones of the first, second and third side edges, the base wall having a slot formed therethrough and commencing adjacent the fourth side edge segment and extending towards the second side edge, the slot sized to receive the cable.

19. An insertable connector assembly according to claim 18, wherein the rearward connector housing portion is a generally rectangularly shaped tube having at least one stop element connected exteriorly thereof and projecting away from the terminal assembly conduit, at least one of the three side walls includes a recess sized and positioned to receive the stop element to releasably retain the seal cover to the rearward connector housing portion.

20. A sealed electrical connector, comprising:

a first terminal assembly including a first cable having an electrically-conductive first core strand, electrically non-conductive first wire insulation surrounding the first core strand, an electrically-conductive first shield layer surrounding the first wire insulation and an electrically non-conductive first sheath surrounding the first shield layer, an electrically-conductive first terminal piece connected to the first core strand, a longitudinally-extending first cavity block member defining a first cavity block member passageway extending longitudinally through the first cavity block member with the first terminal piece slidably received and fixed in the first cavity block member passageway, a longitudinally-extending, electrically-conductive first shielding member defining a first shielding member passageway extending longitudinally through the first shielding member with the first cavity block member slidably received and fixed in the first shielding member passageway with the first shielding member connected to the first shield layer and a first seal connected to the first cable and surrounding and in contact with the first sheath, the first terminal piece being one of a female terminal and a male terminal;

a receiving connector housing having a receiving forward connector housing portion and a receiving rearward connector housing portion connected to the receiving forward connector housing portion, the receiving rearward connector housing portion defining a receiving terminal assembly conduit sized and adapted to slidably receive and fixedly retain the first terminal assembly therein in a close fitting relationship, the receiving rearward connector housing portion having a first receiving rearward connector housing part extending rearwardly from and exteriorly of the receiving forward connector housing portion and a second receiving rearward connector housing part integrally connected to the first receiving rearward connector housing part and extending forwardly into the receiving forward connector housing portion such that the receiving forward connector housing portion surrounds the second receiving rearward connector housing part, the second receiving rearward connector housing part being disposed in a spaced apart relationship from the receiving forward connector housing portion to define a receiving annular cavity between the receiving forward connector housing portion and the second receiving rearward connector housing part;

a second terminal assembly including a second cable having an electrically-conductive second core strand, an electrically non-conductive second wire insulation surrounding the second core strand, an electrically-conductive second shield layer surrounding the second wire insulation and an electrically non-conductive second sheath surrounding the second shield layer, an electrically-conductive second terminal piece connected to the second core strand, a longitudinally-extending second cavity block member defining a second cavity block member passageway extending longitudinally through the second cavity block member with the second terminal piece slidably received and fixed in the second cavity block member passageway, a longitudinally-extending, electrically-conductive second shielding member defining a second shielding member passageway extending longitudinally through the second shielding member with the second cavity block member slidably received and fixed in the second shielding member passageway with the second shielding member connected to the second shield layer and a second seal connected to the second cable and surrounding and in contact with the second sheath, the second terminal piece being a remaining one of the female terminal and the male terminal;

an insertable connector housing having an insertable forward connector housing portion and an insertable rearward connector housing portion connected to the insertable forward connector housing portion, the insertable rearward connector housing portion defining an insertable terminal assembly conduit sized and adapted to slidably receive and fixedly retain the second terminal assembly therein in a close fitting relationship, the insertable forward connector housing portion defining an insertable forward connector housing cavity being in communication with the insertable terminal assembly conduit, the insertable forward connector housing portion having an insertable forward connector housing edge defining an insertable forward connector housing opening into the insertable forward connector housing cavity, the insertable rearward connector housing portion having an insertable rearward connector housing edge defining an insertable rearward connector housing opening being smaller than the insertable forward connector housing opening; and a connector seal having an inner circumferential contact surface and an outer circumferential contact surface, the connector seal surrounding the second receiving rearward connector housing part in the receiving annular cavity with the inner circumferential contact surface of the connector seal in sealing contact with the second receiving rearward connector housing part, wherein, the receiving annular cavity is sized to slidably receive the insertable forward connector housing portion so that, when the receiving and insertable connector housings are connected together, the first and second terminal pieces mate in electrical contact with one another and the connector seal is disposed in the insertable forward connector housing cavity with the outer circumferential contact surface of the connector seal in sealing contact with the insertable forward connector housing portion.

21. A sealed electrical connector according to claim 20, further comprising a receiving seal cover releasably connected to the receiving rearward connector housing portion and in contact with the first seal disposed within the receiving terminal assembly conduit and an insertable seal cover releasably connected to the insertable rearward connector housing portion and in contact with the second seal disposed within the insertable terminal assembly conduit.

22. A sealed electrical connector according to claim 20, wherein the receiving annular cavity has an enlarged receiving annular cavity portion and a reduced receiving annular cavity portion in communication with the enlarged receiving annular cavity portion and the second receiving rearward connector housing part of the receiving rearward connector housing includes an enlarged receiving rearward connector housing part portion and a reduced receiving rearward connector housing part portion extending forwardly of the enlarged receiving rearward connector housing part portion with a stepped down wall delineating the enlarged receiving rearward connector housing part portion and the reduced second receiving rearward connector housing part portion, the enlarged receiving rearward connector housing part portion defining, in part, the reduced receiving annular cavity portion and the reduced receiving rearward connector housing part portion defining, in part, the enlarged receiving annular cavity portion.

* * * * *